US008573252B2

(12) United States Patent
Perrin

(10) Patent No.: US 8,573,252 B2
(45) Date of Patent: Nov. 5, 2013

(54) SHAPE OPTIMIZED HEADERS AND METHODS OF MANUFACTURE THEREOF

(75) Inventor: Ian James Perrin, North Granby, CT (US)

(73) Assignee: ALSTOM Technology Ltd, Baden (CH)

( * ) Notice: Subject to any disclaimer, the term of this patent is extended or adjusted under 35 U.S.C. 154(b) by 235 days.

(21) Appl. No.: 12/956,855

(22) Filed: Nov. 30, 2010

(65) Prior Publication Data

US 2012/0132302 A1 May 31, 2012

(51) Int. Cl.
*F16L 3/01* (2006.01)

(52) U.S. Cl.
USPC ..... 137/561 R; 137/561 A

(58) Field of Classification Search
USPC ..... 137/561 A, 561 R, 602
See application file for complete search history.

(56) References Cited

U.S. PATENT DOCUMENTS

| | | | | |
|---|---|---|---|---|
| 1,792,928 | A * | 2/1931 | Reigart | 285/203 |
| 1,884,481 | A | 10/1932 | Woynarowski | |
| 3,103,942 | A * | 9/1963 | Sharp | 137/1 |
| 3,186,431 | A * | 6/1965 | Moore | 137/561 R |
| 5,083,921 | A * | 1/1992 | Dragan | 433/90 |
| 6,736,191 | B1 | 5/2004 | Lindberg et al. | |
| 2009/0308582 | A1 | 12/2009 | Nagurny et al. | |

FOREIGN PATENT DOCUMENTS

| | | |
|---|---|---|
| EP | 0 501 567 | 9/1992 |
| WO | 2007/088031 | 8/2007 |

OTHER PUBLICATIONS

International Search Report and Written Opinion of the International Searching Authority for PCT/US2011/066425 dated Feb. 21, 2013.

* cited by examiner

*Primary Examiner* — John Rivell
*Assistant Examiner* — Reinaldo Sanchez-Medina
(74) *Attorney, Agent, or Firm* — James J. Cummings

(57) ABSTRACT

Disclosed herein is a shape optimized header comprising a shell that is operative for collecting a fluid; wherein an internal diameter and/or a wall thickness of the shell vary with a change in pressure and/or a change in a fluid flow rate in the shell; and tubes; wherein the tubes are in communication with the shell and are operative to transfer fluid into the shell. Disclosed herein is a method comprising fixedly attaching tubes to a shell; wherein the shell is operative for collecting a fluid; wherein an internal diameter and/or a wall thickness of the shell vary with a change in pressure and/or a change in a fluid flow rate in the shell; and wherein the tubes are in communication with the shell and are operative to transfer fluid into the shell.

18 Claims, 6 Drawing Sheets

SHAPE OPTIMIZED HEADERS AND METHODS OF MANUFACTURE THEREOF

GOVERNMENT LICENSE RIGHTS

This invention was made with government support under Contract 41175 awarded by the US Department of Energy. The government has certain rights in the invention.

BACKGROUND

This disclosure is related to shape optimized headers and to methods of manufacture thereof.

Industrial plants such as chemical plants and power generation facilities often employ headers to collect fluids (e.g., steam and/or other vapors). These headers and the associated distribution hardware are always possessed of circular cross-sectional geometries with uniform wall thicknesses. These geometrical attributes are selected because they can easily be manufactured from available pipe, or by rolling and seam welding plates, or by centrifugal casting. Ease of manufacturing dictates the shapes of the header geometry as well as the wall thicknesses.

The FIGS. 1A and 1B depicts a front view and a side view, respectively, of a current commercially available header 100 (also referred to herein as a "comparative header"). As can be seen from the FIGS. 1A and 1B, the header 100 comprises a shell 102 of a uniform circular cross-sectional internal diameter "d" and a uniform wall thickness "t" that is in communication with an array of tubes 104 that enter the header along its length. The shell 102 is operative to collect a fluid that is discharged into the shell via the array of tubes 104.

The shell 102 comprises a first end 106 and a second end 108 that is opposite to the first end 106. The first end 106 is sealed to the outside, while the second end 108 is in communication with an outlet port (not shown) that permits the evacuation of the fluid that is collected in the header 100 to the outside.

In the depiction shown in the FIGS. 1A and 1B, the steam pressure and/or the fluid flow rate into the header 100 is lowest in the array of tubes 104 that are closest to the first end 106 while it is highest in the array of tubes 104 that are closest to the opposite end. The internal diameter "d" of the shell 102 is determined by considering the pressure drop within the shell 102. This is done to ensure that the array of tubes 104 are controlling the resistance in the system. The diameter d of the shell 102 is also calculated in such a manner as to limit frictional losses in the header itself. This internal diameter d then defines the bore of the pipe used to fabricate the shell 102. Since the entire internal diameter is based upon the cumulative flow of the fluid entering shell 102, the header design shown in the FIGS. 1A and 1B is larger than it needs to be, other than at the outlet plane, and consequently uses a larger amount of material than needed for an efficient design. This increases material costs and results in headers that are expensive and occupy more space in the plant than needed.

As more expensive materials are used to manufacture the headers, these old designs may become cost prohibitive. It is desirable to use geometries and wall thickness that enable cost savings, while at the same time reducing maintenance costs and component breakdowns. It is also desirable to produce headers and associated distribution systems that can operate under existing conditions in a plant for time periods that are as long or longer than the currently existing header designs.

SUMMARY

Disclosed herein is a shape optimized header comprising a shell that is operative for collecting a fluid; wherein an internal diameter and/or a wall thickness of the shell vary with a change in pressure and/or a change in a fluid flow rate in the shell; and tubes; wherein the tubes are in communication with the shell and are operative to transfer fluid into the shell.

Disclosed herein is a method comprising fixedly attaching tubes to a shell; wherein the shell is operative for collecting a fluid; wherein an internal diameter and/or a wall thickness of the shell vary with a change in pressure and/or a change in a fluid flow rate in the shell; and wherein the tubes are in communication with the shell and are operative to transfer fluid into the shell.

DETAILED DESCRIPTION

Figure 1A:
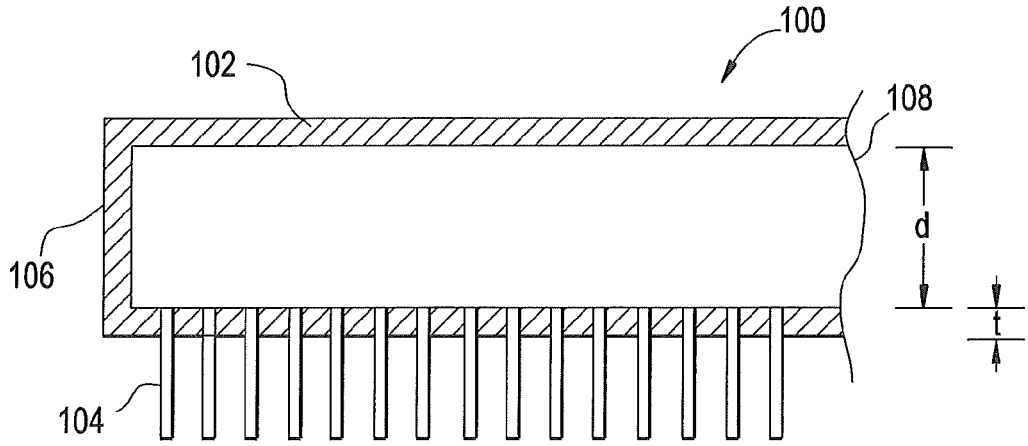
FIG. 1A PRIOR ART
FIG. 1A depicts a front view and FIG. 1B depicts a side view of a current commercially available header 100 (also referred to herein as a "comparative header")

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The transition term "comprising" encompasses the transition terms such as "consisting essentially of" and "consisting of".

All numerical ranges disclosed herein are inclusive of the endpoints. In addition, all numbers and numerical values (including those not expressly stated herein) within a given range are understood to be inherently included within the invention. All numerical values included herein are interchangeable.

Disclosed herein are shaped optimized headers and associated conduits (hereinafter "shape optimized headers") that have cross-sectional areas and wall thicknesses that are optimized for localized operational stress and velocities of fluids (e.g., water, steam and/or other vapors or fluids) encountered during the operation of the header. The shaped optimized headers have shells of variable cross-sectional areas and/or wall thicknesses. The cross-sectional area of a particular portion of the shell of the header and/or the wall thickness varies in proportion to the localized flow and localized stress due to the combination of cumulative flow in the header of the incoming fluid and of geometry of the connecting tubes, and to the velocity of the fluid and/or the chemical composition of the incoming fluid in that particular portion of the shell. The shaped optimized headers are designed in such a manner so as to have larger cross-sectional areas and possibly, larger wall thicknesses (than other cross-sectional areas and wall thicknesses of the same header) only in those localized portions where the header encounters higher stress (due to geometry of incoming tubes) and fluid velocities.

Figure 1B:
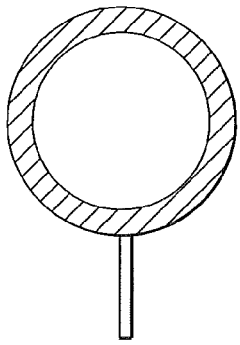

Those sections of the shell that experience lower fluid velocities than those in close proximity to the outlet(s) have smaller cross-sectional areas and smaller wall thicknesses than the corresponding cross-sectional areas and wall thicknesses of shell designed in the conventional manner as that depicted in the FIGS. 1A and 1B.

The resulting shaped optimized headers can have numerous cross-sectional areas and wall thicknesses depending upon the localized stress and fluid velocities encountered during operation. In one embodiment, shape optimized headers can also use different materials of construction depending upon the chemistry of fluids encountered in different sections. The shaped optimized headers can be made of specialized materials that are more expensive than those used in the headers depicted in the FIGS. 1A and 1B, but because of the optimized design can cost less than if the header of the FIGS. 1A and 1B were constructed from the same specialized materials.

These shaped optimized headers are also advantageous in that they use less floor space and volumetric space in a plant and can be used in operation for as long or for longer periods of time than headers designed in the manner depicted in the FIGS. 1A and 1B.

Figure 2A:
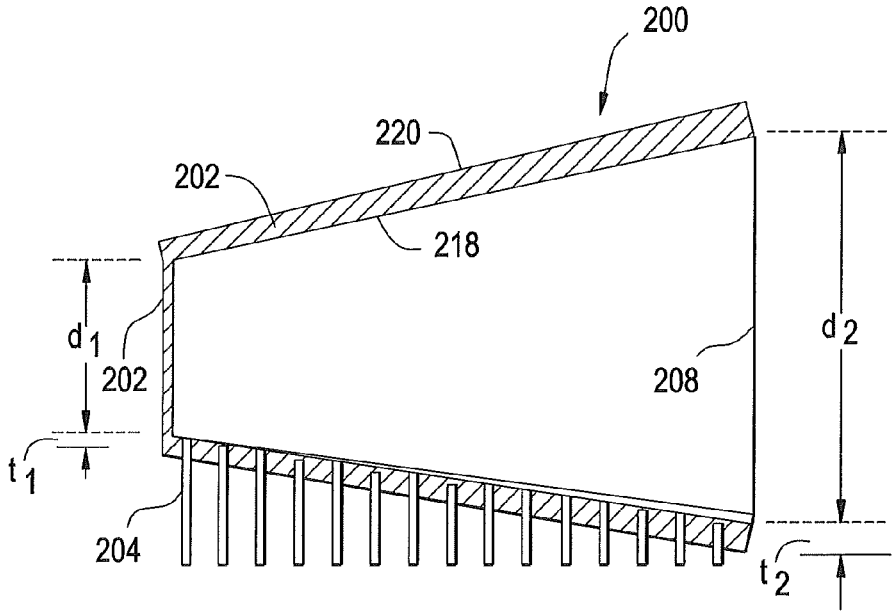
FIG. 2A depicts a shape optimized version of the comparative header of the FIGS. 1A and 1B in accordance with the present invention.
Figure 2B:
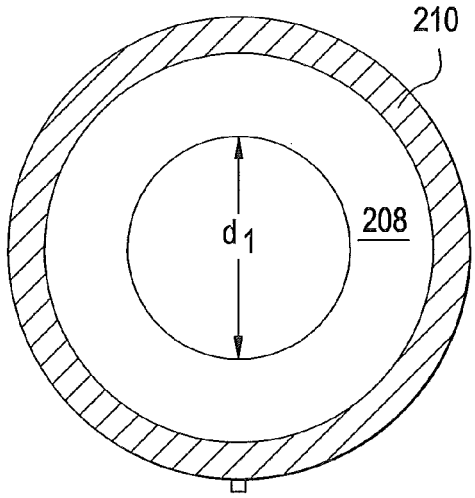

The FIGS. 2A and 2B depicts a shape optimized version of the comparative header of the FIGS. 1A and 1B. In the FIGS. 2A and 2B, the shape optimized header 200 comprises a shell 202 (in the form of a conical section) 202 having a circular cross-sectional internal diameter that varies from a minimum diametric value of $d_1$ (at the end where the stress and/or fluid flow rate is lowest) to a maximum diametric value $d_2$ at the opposite end (where the stress and/or fluid flow rate is greatest). The wall thickness also varies from a minimum wall thickness of $t_1$ (at the end where the stress and/or fluid flow rate is lowest) to a maximum wall thickness of $t_2$ at the opposite end (where the stress and/or fluid flow rate is greatest).

The header 200 comprises a first end 206 and a second end 208 that is opposite the first end 206. The first end 206 is sealed to the outside (i.e., fluid from the outside cannot enter or leave the shell 202 via the first end 206), while the second end 208 is in communication with an outlet port (not shown) that permits the evacuation of the header 200 to the outside. While the FIGS. 2A and 2B depicts a smooth linear variation in the cross-sectional area of the header and a smooth linear variation in the wall thickness from the first end 206 to the second end 208, other variations may also be used. For example, the variation in either the cross sectional area or the thickness may be non-linear (e.g., curvilinear, varied according to an exponential or spline function, varied randomly in a discontinuous manner, or combinations thereof) according to the localized stress and/or fluid flow rate into the header. The inner surface 218 or outer surface 220 of the header 200 may be a continuously varying surface or it may be a discontinuously varying surface (i.e., one with variations that are similar to a step function), or it may be a combination thereof.

In one embodiment, the increase in the diameter and/or in the wall thickness of the shell is proportional to the local increase in the pressure experienced in different sections of the header and can be expressed by the equation (1) as follows:

$$\frac{d_2}{d_1} = \frac{t_2}{t_1} = \frac{p_2}{p_1}, \tag{1}$$

where $d_2$, $d_1$, $t_2$ and $t_1$ are indicated in the FIG. 2 and where $p_2$ is the highest pressure and $p_1$ is the lowest pressure encountered in the different sections of the header.

In another embodiment, the change in diameter and/or the change in the wall thickness of the shell is proportional to a change in local pressure experienced in the shell and determined by the equation (1a):

$$\frac{\Delta d_2}{\Delta d_1} = \frac{\Delta t_2}{\Delta t_1} = \frac{\Delta p_2}{\Delta p_1}, \tag{1a}$$

where $\Delta d_2$ is the change in the internal diameter of a second section of the shell, $\Delta d_1$ is the change in the internal diameter of a first section of the shell, $\Delta t_2$ is the change in the wall thickness of a second section of the shell, $\Delta t_1$ is the change in the wall thickness of a first section of the shell, where $\Delta p_2$ is the change in pressure experienced in the second section of the shell and $\Delta p_1$ is the change in pressure encountered in the first section of the shell.

In yet another embodiment, the increase in the diameter and/or in the wall thickness of the shell is proportional to the increase in the fluid flow rate experienced in different sections of the header and can be expressed by the equation (2) as follows:

$$\frac{d_2}{d_1} = \frac{t_2}{t_1} = \frac{f_2}{f_1}, \tag{2}$$

where $d_2$, $d_1$, $t_2$ and $t_1$ are indicated in the FIGS. 2A and 2B and where $f_2$ is the maximum fluid flow rate and $f_1$ is the minimum fluid flow rate encountered in the different sections of the header.

In another embodiment, a change in diameter and/or a change in a wall thickness of the shell is proportional to a change in fluid flow rate experienced in the shell and determined by the equation (2a):

$$\frac{\Delta d_2}{\Delta d_1} = \frac{\Delta t_2}{\Delta t_1} = \frac{\Delta f_2}{\Delta f_1}, \tag{2a}$$

where $\Delta d_2$ is the change in the internal diameter of a second section of the shell, $\Delta d_1$ is the change in the internal diameter of a first section of the shell, $\Delta t_2$ is the change in the wall thickness of a second section of the shell, $\Delta t_1$ is the wall thickness of a first section of the shell, where $\Delta f_2$ is the change in the fluid flow rate experienced in the second section of the shell and $\Delta f_1$ is the change in the fluid flow rate encountered in the first section of the shell.

In one embodiment, in one manner of designing the header, Page: 8 it is desirable to maintain a uniform velocity or fluid flow rate along the length of the header. The flow rate or velocity is proportional to the cross sectional area of the header, and is therefore proportional to the square of the internal diameter of the header as shown in the equation (3).

$$\frac{f_1}{f_2} = \frac{A_1}{A_2} = \frac{d_1^2}{d_2^2} \tag{3}$$

where $f_2$ is the fluid flow rate experienced in the second section of the shell and $f_1$ is fluid flow rate encountered in the first section of the shell, $A_1$ and $A_2$ are the cross-sectional areas of those portions of the shell that encounter the fluid flows $f_1$ and $f_2$ respectively, while $d_1$ and $d_2$ are the respective internal diameters of the header at those portions of the shell that encounter the fluid flows $f_1$ and $f_2$ respectively.

The thickness of the header is varied to maintain uniform stress due to the pressure in the header. The stress is equal to the product of pressure and diameter, divided by thickness. In other words, the stress is proportional to diameter but is inversely proportional to thickness as shown in the equations (4) and (5).

$$\sigma = \frac{p * d}{t} \tag{4}$$

where p is the pressure in a given portion of the header, d is the internal diameter of the header and t is the wall thickness of the header.

$$\frac{\sigma_1}{\sigma_2} = \frac{p_1 * d_1 * t_2}{p_2 * d_2 * t_1} \tag{5}$$

where $d_2$ is the internal diameter of a second section of the shell, $d_1$ is the internal diameter of a first section of the shell, $t_2$ is the wall thickness of a second section of the shell, $t_1$ is the wall thickness of a first section of the shell, where $p_2$ is the pressure experienced in the second section of the shell and $p_1$ is pressure encountered in the first section of the shell and where $\sigma_2$ and $\sigma_1$ are the stresses encountered in the second section of the shell and in the first section of the shell respectively. From the equations (4) and (5), it may be seen that for a given pressure, the stress may be maintained constant by reducing the diameter and the wall thickness by the same amount.

Figure 3:
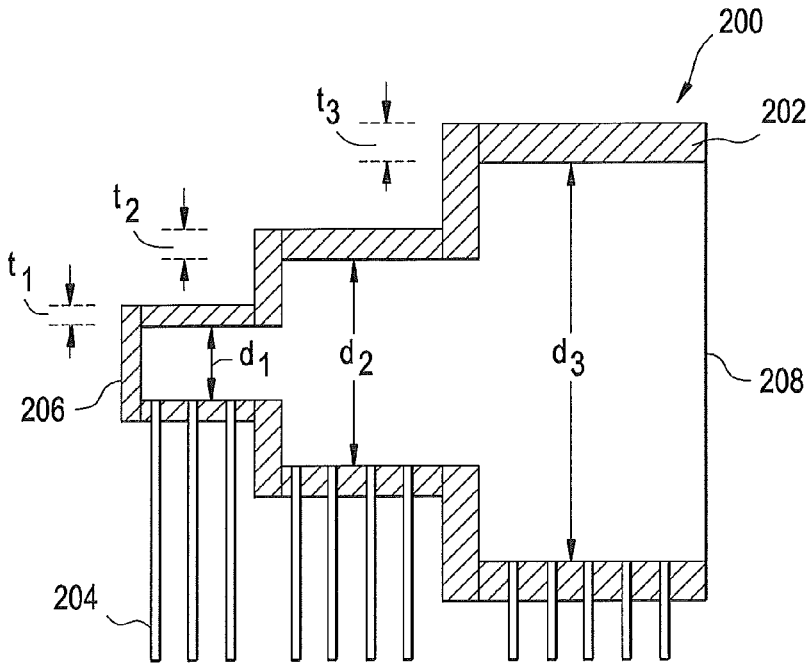
FIG. 3 is a front view of an exemplary embodiment that depicts the header 200 of the FIGS. 2A and 2B, with the exception that the cross-sectional area of the shell is increased from the first end 206 to the second end 208 in a step-wise manner.

The FIG. 3 is a front view of an exemplary embodiment that depicts the header 200 of the FIGS. 2A, 2b and 3 with the exception that the cross-sectional area of the shell is increased from the first end 206 to the second end 208 in a step-wise manner. This increase in the cross-sectional area varies with the increase in the local pressure and/or the fluid flow rate as witnessed in the equations (1) and (2) above. As the cross-sectional area is increased, the wall thickness t is increased as well to compensate for the increases in the pressure and/or the fluid flow rate.

From the FIG. 3 it may be seen that the cross-sectional area increases from $d_1$ to $d_2$ to $d_3$ and the wall thickness increases from $t_1$ to $t_2$ to $t_3$ as pressure increases from $p_1$ to $p_2$ to $p_3$ and/or the fluid flow rate increases from $f_1$ to $f_2$ to $f_3$.

Figure 4:
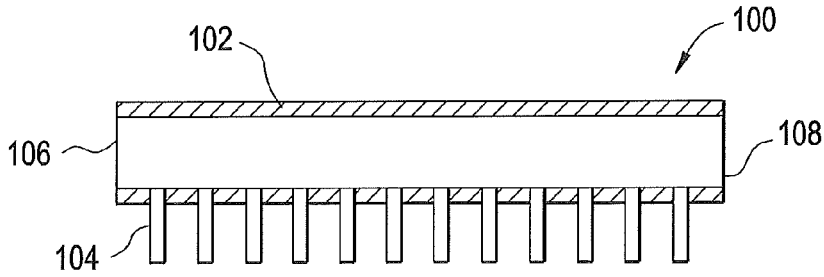
FIG 4 PRIOR ART
FIG. 4 shows a comparative configuration (prior art) for a header 100 having a plurality of outlets.
Figure 5:
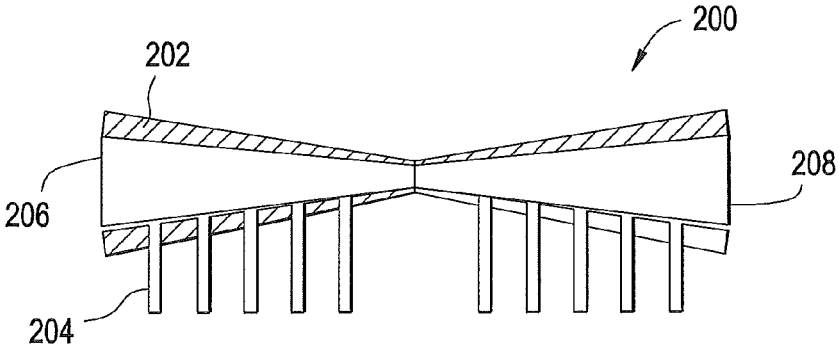
FIG. 5 shows a shaped optimized configuration for the same header of the FIG. 4 having a plurality of outlets in accordance with the present invention.

While the headers 200 in the FIGS. 2A, 2B and 3 each have a single outlet at the second end 208, there can be two or more outlets if desired. The FIG. 5 shows headers 200 that have the plurality of outlets. The FIG. 4 shows a comparative configuration for a header 100 having a plurality of outlets while the FIG. 5 shows a shaped optimized configuration for the same header 200 having a plurality of outlets. In the FIG. 5, the cross-sectional area of the shell 202 is greatest near the outlets at the first end 206 and the second end 208 since these regions experience the highest pressures and/or fluid flow rates. The wall thickness at the outlet regions is greater than the wall thickness at other regions of the header. As noted above, the outlets located near the first end 206 and the second end 208 of the header are used to remove the fluid or vapor being conveyed by the header from the header 200.

Figure 6A:
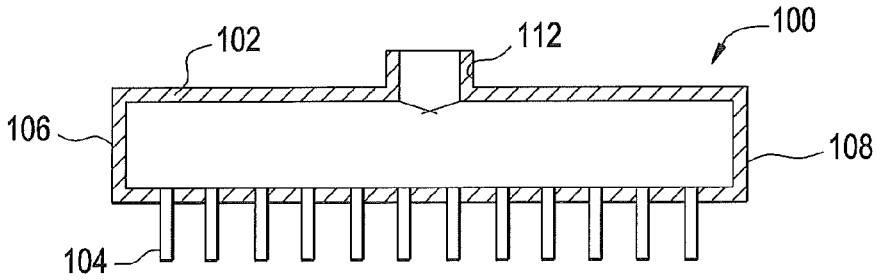
FIG. 6A PRIOR ART
FIG. 6A shows a comparative configuration (prior art) for a header 100 having the central tee.
Figure 7A:
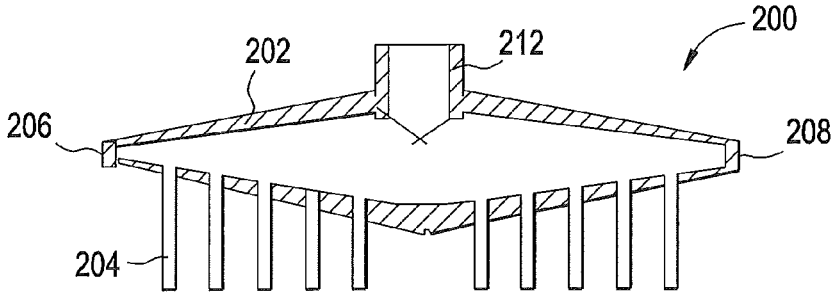
FIG. 7A shows a shaped optimized configuration for the same header 200 having a single outlet in accordance with the present invention.
Figure 6B:
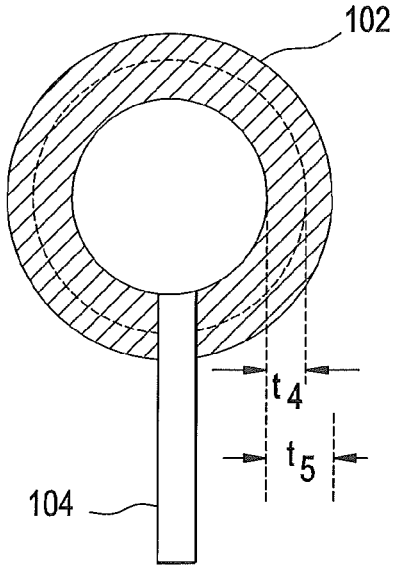
FIG. 6B PRIOR ART
FIG. 6B depicts a cross section of a comparative header wall 100 at the point where the tube 104 contacts the wall of the shell 102 of the FIG. 6A.

The FIG. 6A shows a comparative header along with a shape optimized header for a design having a central tee that serves as the outlet. The FIG. 7A shows a comparative configuration for a header 100 having the central tee while the FIG. 6B shows a shaped optimized configuration for the same header 200 having a single outlet. The central tee 212 is used as an outlet in the FIG. 7A while it is listed as 112 in the FIG. 6A.

From the FIG. 7A it may be seen that the cross-sectional area of the shell is greatest at the center of the header because this is the region where the pressure and/or the fluid flow rate is greatest. Similarly, the wall thickness is greatest at the center. The wall thickness of the shell is narrowest at the opposite ends 206 and 208 where the pressure and/or the fluid flow rate, is the lowest.

In the absence of tube (204) penetrations and/or any other penetrations into the wall of the header, the wall thickness is determined by the internal pressure that the header has to withstand during normal operation, or as defined by a fault case or other condition as defined by prevailing codes, standards or other design rules. This principle is generally applied to the wall thickness of regions where the tubes are affixed to the wall of the header as well. However, these regions can be weakened by the addition of the tubes to the wall. In addition, these regions see a greater amount of utility since all of the fluids that enter the header contact the tubes 204. The fluids that enter the header also contact the region of the header around the tubes 204 because of the proximity of the region to the point of entry of the fluid. The regions where the fluid enters the header therefore gets weakened more rapidly than other regions of the header.

In one embodiment, the regions where the tubes 204 are affixed to the walls of the header 200 may be increased in thickness in order to provide additional reinforcement to a region that would normally be weakened due to the removal of material to provide paths for entry of fluid from the tubes to the shell. The reinforcement also provides a longer life cycle to a region that sees greater usage than other regions during the course of operation of the header. This increase in thickness is local and is undertaken only in an appropriate vicinity to those regions where the tubes 204 are fixedly attached to the header.

Figure 7B:
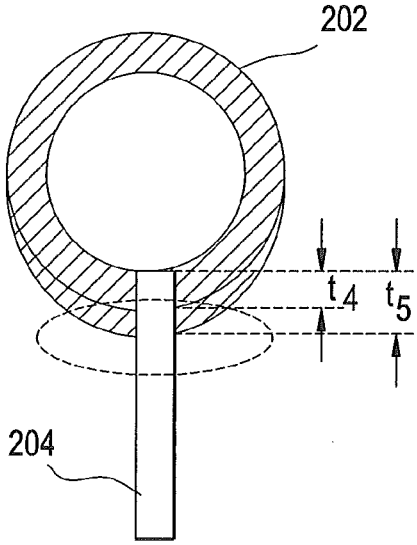
FIG. 7B depicts a cross sectional view of the wall of a shape optimized header 200 of the FIG. 7A.

In one embodiment depicted in the FIG. 7B, the regions of the wall to which the tubes 204 are fixedly attached are thickened to locally compensate for material removed by forming penetrations for the tubes to communicate with the shell, or to overcome wear and degradation that occurs with increased usage. This increase in local thickness provides the header with increased life cycle performance while at the same time reducing the weight of the header and reducing material costs.

The FIG. 6B depicts a cross section of a comparative header wall 100 at the point where the tube 104 contacts the wall of the shell 102. The header wall 100 would normally have a thickness of $t_4$ if the tube 104 were not contacted to the header. In order to compensate for structural weaknesses because of the presence of the tube 104, the thickness of the header wall 100 is increased to $t_5$. This increase in thickness from $t_4$ to $t_5$ in a conventional header causes increases in material costs and in the weight of the finished header.

FIG. 7B depicts a cross sectional view of the wall of a shape optimized header 200. In the shape optimized header 200, the wall thickness for the header is $t_4$ except in an appropriate vicinity to those regions where the tube 204 is fixedly attached to the header, where it is increased to $t_5$. This local increase in thickness ensures uniformity of stress in the header while actually decreasing the weight when compared with the weight of the comparative header of the FIG. 6B.

The shell of the header 200 may be manufactured from iron based alloys, nickel based alloys, tantalum based alloys, and titanium based alloys.

In one embodiment, in one method of manufacturing the shape optimized header, a shell in the form of a conical section having a smaller diameter $d_1$ (corresponding to the lower flow rate $f_1$) and a larger diameter $d_2$ (corresponding to the higher flow rate $f_2$) at an end opposed to the smaller diameter $d_1$ has its opposing ends sealed to prevent fluid from inside the shell from contacting the outside. An outlet (or an inlet—inlets can also serve as outlets) is then drilled or cut in a portion of the shell. The outlet is used to evacuate the shell of its contents. Holes are drilled in the shell to accommodate the tubes that discharge fluid into the shell.

In one embodiment, in one method of manufacturing a shape optimized header having a smooth increase in cross sectional area (from those portions of the header that experience lower pressure to those portions of the header that experience higher pressures), a roll of sheet metal (e.g., a scroll of metal) is held or fixed at one end while the opposite end is extended from the fixed end. The metal is extended radially outwardly from the center of the scroll in addition to being extended longitudinally so that with each turn of the sheet metal, the diameter of the header increases along with the length. When the length and the diameter have reached the desired limits, the overlapping sheets may be seam welded or riveted together to form the shell of the header. The ends of the header may be cut off to form two parallel ends. The ends of the header may be welded onto the shell. One end may be sealed against the outside, while the other end has an opening through which the contents of the header are removed for recycling or discharged to waste.

Since it is generally desirable to increase the wall thickness in the direction of increasing cross-sectional area, a scroll of sheet metal of gradually increasing thickness can be used to manufacture the header as described above. In producing a header (shell) from such a sheet, the thinnest section is held fixed while the thickest section of the scroll is extended outwardly away from the thinnest section to produce a shell of smoothly increasing cross-sectional area and increasing wall thickness as well.

Holes may be drilled in a surface of the shell in order to fixedly attach the tubes to the header. The tubes may be welded onto the shell as shown in the FIGS. 2-5 above. In another embodiment, the tubes may be screwed into threads formed in the walls of the shell, or welded to the shell. In one embodiment, the shell may be optionally thickened in the local region surrounding the tubes by using techniques such as laser welding. Other techniques used for forming the header and for local reinforcing are conventional casting, spray casting, spray forming and powder metallurgy.

In another embodiment, in another manner of manufacturing a header where the cross-sectional areas increase in a step function manner as seen in the FIG. 3 (from those portions of the header that experience lower pressure to those portions of the header that experience higher pressures), pipes (spools) of varying desired diameters and thicknesses are first cut and then welded or riveted together to form the header. The ends of the header and the tubes are then welded together to form the header.

In addition to achieving materials savings from shape optimization, the use of thinner walls and shells reduces thermal stresses and increase the life cycle and the durability of the header or other devices manufactured using these methods and principles. Another advantage is that the decreased diameter and wall thickness results in smaller weldments (fewer passes) to joins several spools to form a large header.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A shape optimized header comprising:

a shell that is operative for collecting a fluid; wherein an internal diameter and/or a wall thickness of the shell vary with a change in pressure and/or a change in a fluid flow rate in the shell; and tubes; wherein the tubes are in communication with the shell and are operative to transfer fluid into the shell;

wherein a change in the internal diameter or a change in the wall thickness of the shell is proportional to a change in local pressure experienced in the shell and determined by the equation (1a):

$$\frac{\Delta d_2}{\Delta d_1} = \frac{\Delta t_2}{\Delta t_1} = \frac{\Delta p_2}{\Delta p_1}, \tag{1a}$$

where $\Delta d_2$ is the change in the internal diameter of a second section of the shell, $\Delta d_1$ is the change in the internal diameter of a first section of the shell, $\Delta t_r$ is the change in the wall thickness of a second section of the shell, $\Delta t_1$ is the change in the wall thickness of a first section of the shell, where $\Delta p_2$ is the change in pressure experienced in the second section of the shell and $\Delta p_1$ is the change in pressure encountered in the first section of the shell.

2. The shape optimized header of claim 1, where the shape optimized header further comprises an outlet that is used for discharging fluids collected in the header.

3. The shape optimized header of claim 1, wherein the shape optimized header comprises a plurality of outlets that are operative to discharge fluids collected in the header.

4. The shape optimized header of claim 1, where the wall thickness of a section of the shell that contacts the tubes is increased.

5. The shaped optimized header of claim 1, where the shell has a shape of a conical section.

6. A shape optimized header comprising:

a shell that is operative for collecting a fluid; wherein an internal diameter and/or a wall thickness of the shell vary with a change in pressure and/or a change in a fluid flow rate in the shell; and tubes; wherein the tubes are in communication with the shell and are operative to transfer fluid into the shell;

wherein a change in the internal diameter or a change in the wall thickness of the shell is proportional to a change in fluid flow rate experienced in the shell and determined by the equation (2a):

$$\frac{\Delta d_2}{\Delta d_1} = \frac{\Delta t_2}{\Delta t_1} = \frac{\Delta f_2}{\Delta f_1}, \tag{2a}$$

where $\Delta d_2$ is the change in the internal diameter of a second section of the shell, $\Delta d_1$ is the change in the internal diameter of a first section of the shell, $\Delta t_2$ is the change in the wall thickness of a second section of the shell, $\Delta t_1$ is the wall thickness of a first section of the shell, where $\Delta f_2$ is the change in the fluid flow rate experienced in the second section of the shell and $\Delta f_1$ is the change in the fluid flow rate encountered in the first section of the shell.

7. The shape optimized header of claim 6, where the shape optimized header further comprises an outlet that is used for discharging fluids collected in the header.

8. The shape optimized header of claim 6, wherein the shape optimized header comprises a plurality of outlets that are operative to discharge fluids collected in the header.

9. The shape optimized header of claim 6, where the wall thickness of a section of the shell that contacts the tubes is increased.

10. The shaped optimized header of claim 6, where the shell has a shape of a conical section.

11. A shape optimized header comprising:

a shell that is operative for collecting a fluid; wherein an internal diameter and/or a wall thickness of the shell vary with a change in pressure and/or a change in a fluid flow rate in the shell; and tubes; wherein the tubes are in communication with the shell and are operative to transfer fluid into the shell;

wherein a change in the internal diameter or a change in the wall thickness of the shell is proportional to a change in the stress experienced in the shell and determined by the equation (5):

$$\frac{\sigma_1}{\sigma_2} = \frac{p_1 * d_1 * t_2}{p_2 * d_2 * t_1}, \tag{5}$$

where $d_2$ is an internal diameter of a second section of the shell, $d_1$ is an internal diameter of a first section of the shell, $t_2$ is the wall thickness of a second section of the shell, $t_1$ is the wall thickness of a first section of the shell, where $p_2$ is the pressure experienced in the second section of the shell and $p_1$ is pressure encountered in the first section of the shell and where $\sigma_2$ and $\sigma_1$ are the stresses encountered in the second section of the shell and in the first section of the shell respectively.

12. The shape optimized header of claim 11, where the shape optimized header further comprises an outlet that is used for discharge fluids collected in the header.

13. The shape optimized header of claim 11, wherein the shape optimized header comprises a plurality of outlets that are operative to discharge fluids collected in the header.

14. The shape optimized header of claim 11, where the wall thickness of a section of the shell that contacts the tubes is increased.

15. The shaped optimized header of claim 11, where the shell has a shape of a conical section.

16. A method comprising:

discharging a fluid from a shape optimized header comprising:

a shell that is operative for collectin a fluid; wherein an internal diameter and/or a wall thickness of the shell vary with a change in pressure and/or a change in a fluid flow rate in the shell;

tubes; wherein the tubes are in communication with the shell and are operative to transfer fluid into the shell;

wherein a change in the internal diameter or a change in the wall thickness of the shell is proportional to a change in local pressure experienced in the shell and determined by the equation (1a):

$$\frac{\Delta d_2}{\Delta d_1} = \frac{\Delta t_2}{\Delta t_1} = \frac{\Delta p_2}{\Delta p_1}, \tag{1a}$$

where $\Delta d_2$ is the change in the internal diameter of a second section of the shell, $\Delta d_1$ is the change in the internal diameter of a first section of the shell, $\Delta t_2$ is the change in the wall thickness of a second section of the shell, $\Delta t_1$ is the change in the wall thickness of a first section of the shell, where $\Delta p_2$ is the change in pressure experienced in the second section of the shell and $\Delta p_1$ is the change in pressure encountered in the first section of the shell.

17. The method of claim 16 further comprising discharging fluid from the shell via an outlet.

18. The method of claim 16 further comprising discharging fluid from the shell via a plurality of outlets.

* * * * *